United States Patent [19]

Alessandro

[11] Patent Number: 5,058,702

[45] Date of Patent: Oct. 22, 1991

[54] SILENCER DEVICE FOR EXHAUSTS OF MOTORS AND SIMILAR, WITH ACOUSTIC INTERFERENCE

[76] Inventor: Mascioli Alessandro, Via Pio Foá, 45, Rome, Italy

[21] Appl. No.: 362,391

[22] PCT Filed: Oct. 11, 1988

[86] PCT No.: PCT/IT88/00072

§ 371 Date: May 22, 1989

§ 102(e) Date: May 22, 1989

[87] PCT Pub. No.: WO89/03472

PCT Pub. Date: Apr. 20, 1989

[30] Foreign Application Priority Data

Oct. 12, 1987 [IT] Italy ..... 48488 A/87

[51] Int. Cl.[5] ..... F01N 1/06

[52] U.S. Cl. ..... 181/206; 381/71

[58] Field of Search ..... 181/206–209; 381/71

[56] References Cited

U.S. PATENT DOCUMENTS 3,396,812 8/1968 Wilcox et al. ..... 181/250

4,109,108 8/1978 Coxon et al. ..... 181/206 X

FOREIGN PATENT DOCUMENTS 1194562 11/1959 France .

1478901 4/1967 France .

560952 6/1977 U.S.S.R. ..... 181/206

*Primary Examiner*—Brian W. Brown

*Attorney, Agent, or Firm*—Beveridge, DeGrandi & Weilacher

[57] ABSTRACT

The device reduces the intensity of noises with localized outlet like those present in the exhaust pipes of endothermic motors, making use of sound-interferences determined by an elastic vibration by means of springs (10) or (12) or (15) of a rigid rod (6) having its fulcrum in (11) and passing through coupled tubes (1) and (2). The acoustic waves spreading in the exhaust and acting onto blade (7) out of one piece with said rod (6) inside the exhaust pipe (1), determine the vibration of the corresponding blade (8) out of one piece with the opposite part of said rod (6) and housed in the coupled pipe (2) so as to generate vibrations in perfect phase opposition interfering at the exhaust pipe's outlet, thus anulling or strongly reducing the noise.

9 Claims, 2 Drawing Sheets

6
7
11
1
5
4
3
10
8
9
2

9
6
11
7
1
8
3
2
5

FIG.3
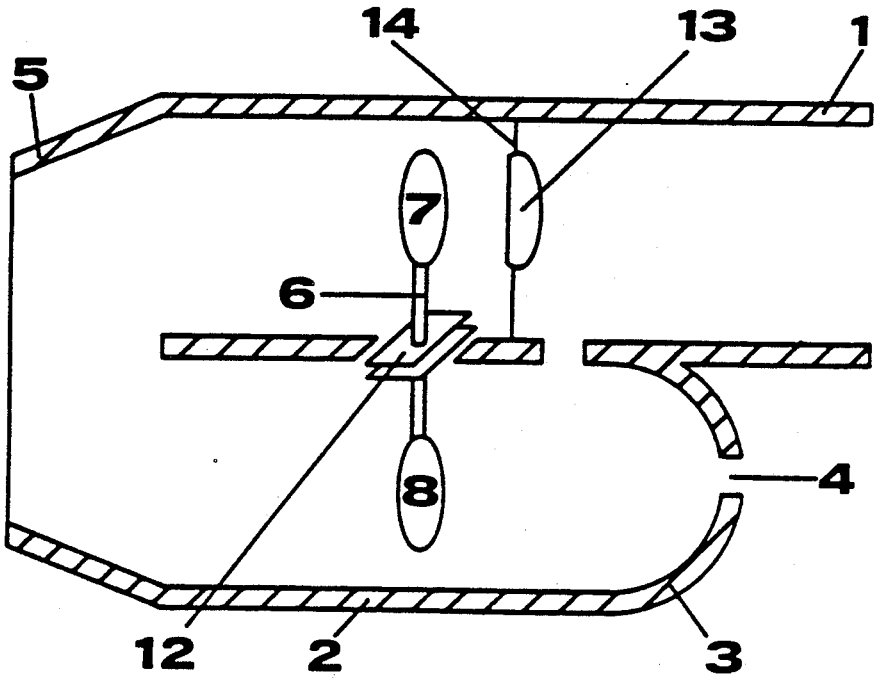
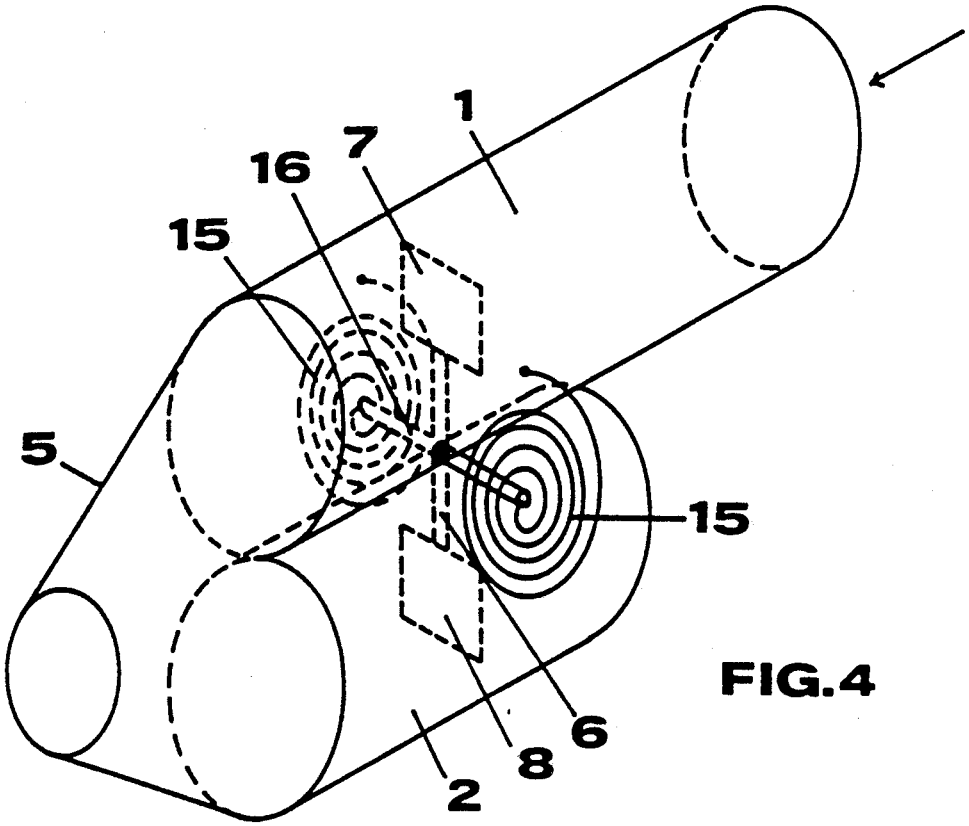
FIG.4

SILENCER DEVICE FOR EXHAUSTS OF MOTORS AND SIMILAR, WITH ACOUSTIC INTERFERENCE

The present invention concerns a silencer device for exhausts of motorcycles, vehicles, air conditioners, air compressors and all other acoustic pollution sources.

Until today the attempt of reducing the noise, which is one of the most serious components of the pollution in the industrial society, has been developed with sound-absorbing means suited for reducing the intensity thereof.

In particular for what concerns the reduction of the noises produced by the exhausts of motors of any kind, the outlet gases are forced to pass through winding passages and hurt against absorbing walls which however do not determine a sound reduction level that makes the civic centers, the working ambients and places like autodromes and the like more comfortable.

It is the aim of the present invention to completely eliminate the noises produced by the exhausts of motors, conditioners, compressors and similar by means of a process different that absorption.

It is already known that the physical phenomenon of interference allows in case of overlaying of acoustic waves in phase opposition, to anul a sound with a "counter-sound", characterized in a phase-displacement corresponding to a displacement of ½ wave length.

It is the aim of the present invention to realize an active silencer device that will produce for each sound passing through the exhaust pipe of any kind of motor, a corresponding counter-sound in phase opposition that will be superimposed to the primary sound in correspondence to the noise's outlet, thus anulling it.

The evident advantage of the present invention consists in the capacity of the device to make any noise source with localized outlet noiseless, without therefore causing any reduction in the efficiency of the motor itself but, on the contrary, improving the functioning of the same.

The present invention will be explained more in detail hereinbelow relating to the enclosed drawings in which a preferred embodiment is shown.

FIG. 3 shows a scheme of a mechanical variant of the device according to the present invention.

FIG. 4 shows a scheme of a variant of the device according to the present invention provided with external springs.

Figure 1:
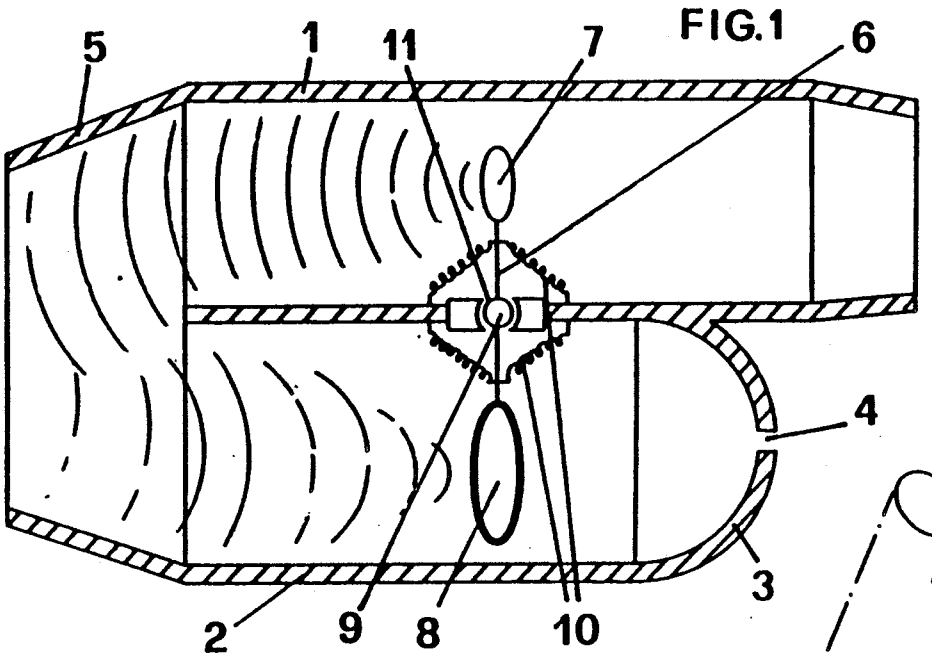
FIG. 1 shows a vertical section of a silencer device for exhausts of motors and similar with acoustic interference.
Figure 2:
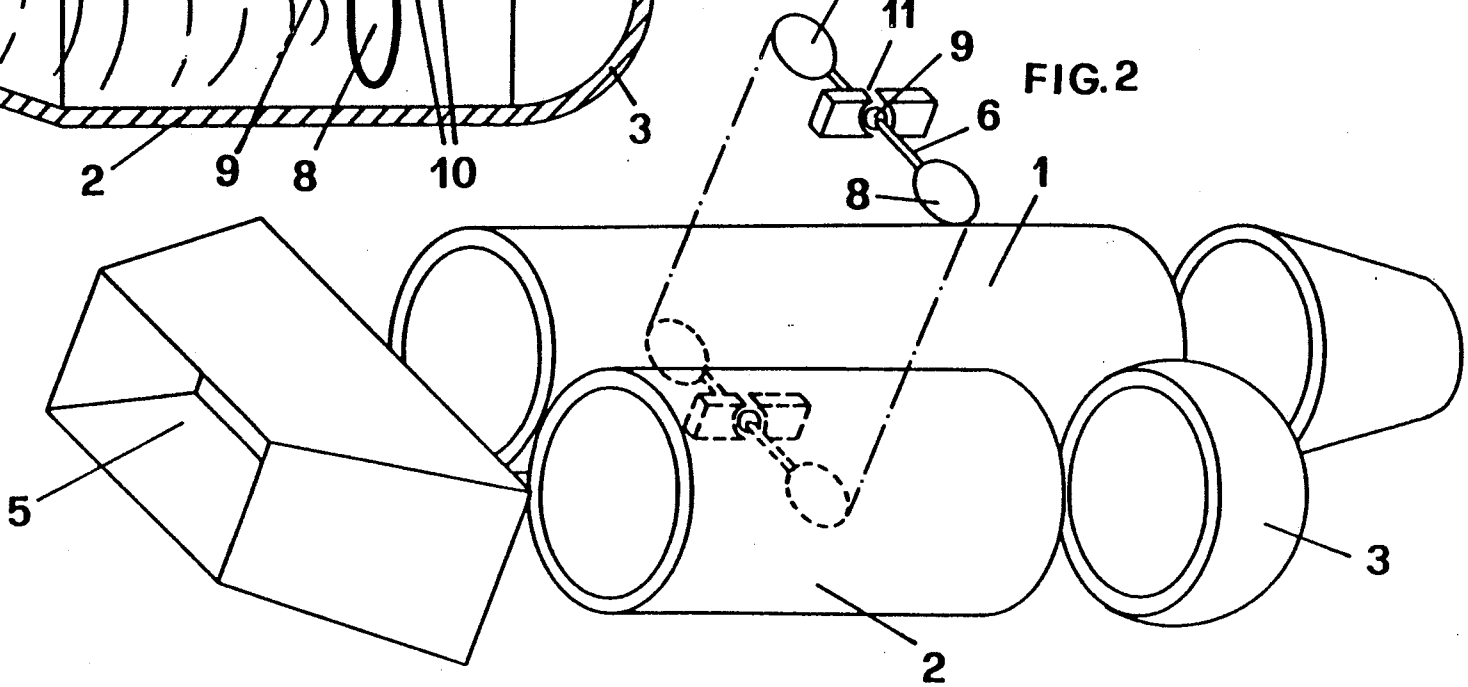
FIG. 2 shows an axonometric exploded view of the device according to FIG. 1.

The figures show a silencer device for exhausts of motors and similar with acoustic interference, consisting of a pipe 1 with walls being insulating against heat and sounds with amianthus, that may be applied, in a well known manner, to exhaust pipes of any kind, or that may be obtained inside the end part of said pipes.

To said first pipe 1 a second pipe 2 is applied parallel and out of one piece, being closed at the end of the semispherical cap 3 with hole(s) 4 for the air from the outside.

Said parts 1 and 2 converge in the same outlet end 5 being preferably outwardly tapered.

A main feature of the device according to the present invention consists in the rigid rod 6 passing through an opening 11 provided in said parts 1 and 2, and provided with end blades 7 and 8 having its fulcrum on the spherical knot 9 or similar, placed in the point of contact of said parts of the pipes 1 and 2 and that will elastically vibrate due to the presence of springs or similar applied on both sides, under the impulse of the acoustic waves spreading in the exhausts in part 1 and acting onto blade 7 so that the corresponding blade 8 produces vibrations in the air entering pipe 2 through hole 4, in perfect phase opposition with respect to the exhaust waves.

In fact, to each compression phase of said blade 7 an opposite phase of rarefaction of the coupled blade 8 corresponds and vice versa, so that blade 8 in turn produces a sound in phase opposition to the one spreading in the exhaust and acting on said blade 7.

Said two composed sounds, or noises, now reach outlet end 5 overlapping and therefore reciprocally anulling themselves according to the aim set forth.

For what concerns the variant according to FIG. 3, above mentioned springs 10 are replaced by an elastic blade 12 preferably out of a double steel layer or similar, for making the vibration of said rigid rod 6 elastic in correspondence with each frequence of the sound wave spreading in the exhaust and therefore in the part of pipe 1.

In all variations the present invention provides a jet-breaker 13 fixed to the walls of pipe 1 by means of small bars 14 or similar, placed for exactly covering blade 7 and provided with an aerodynamic shape such as to deviate the exhaust flow and to prevent said blade 7, even if always vibrating due to the resonance with the sound waves coupled to the exhaust, from getting inclined by the mechanical impact of the exhaust, improving the efficiency thereof.

Should the temperature of the exhaust be such as to reduce the elasticity of the internal springs 10 or 12, the present invention provides, in a variant; that the vibrations of the rigid rod 6 be determined, through a transversal rod 16, by helicoidal springs 15 or springs of any other kind housed outside pipes 1 and 2, as shown in FIG. 4.

I claim:

1. A silencer for reducing the noise of exhaust gases, comprising, a first pipe for carrying exhaust gases which generate a sound having acoustic waves of one phase, a second pipe, outlet section means for receiving and combining gases from said first and second pipes and for releasing said gases from a common outlet;

a first blade located in said first pipe, a second blade located in said second pipe, a connector connecting said first and second blades together, said connector being movable about an axis which is between said blades so that the first and second blades move in opposite directions, elastic means for supporting the blades and the connector for vibrating movement in response to acoustic waves applied to the first blade in the first pipe, to vibrate the second blade and gases in the second pipe to produce acoustic waves at a phase which is opposite to the phase of the acoustic waves in the first pipe, whereby the gases from the first and second pipes will have a reduced noise at said common outlet.

2. A silencer according to claim 1 wherein the second pipe has an inlet end provided with a semispherical cap which has an air inlet opening.

3. A silencer according to claim 1 including a fulcrum which supports the connector between the two pipes.

4. A silencer according to claim 3 wherein the fulcrum is a spherical knot.

5. A silencer according to claim 1 wherein the elastic means is a plurality of coil springs.

6. A silencer according to claim 1 wherein the elastic means includes a third blade which is elastic.

7. A silencer according to claim 1, including jet-breaker means fixed in the first pipe upstream of the first blade, said jet-breaker means having an aerodynamic shape for deflecting the flow of exhaust gases in the first pipe.

8. A silencer according to claim 1 including a support rod which is connected transversely to the connector, and the elastic means includes helicoidal springs which are connected to the support rod.

9. A silencer according to claim 8 wherein the helicoidal springs are located outside of said pipes.

* * * * *